US005913557A

United States Patent [19]

Jarock

[11] Patent Number: 5,913,557

[45] Date of Patent: Jun. 22, 1999

[54] HAND GUN LIFTING AND CARRYING DEVICE

[76] Inventor: Joseph Jarock, 116 Hay Rd. Winslow, Hammonton, N.J. 08037

[21] Appl. No.: 09/025,100

[22] Filed: Feb. 17, 1998

[51] Int. Cl.[6] ..... B25J 1/04

[52] U.S. Cl. ..... 294/15; 294/158

[58] Field of Search ..... 294/1.1, 3.5, 5, 294/5.5, 15, 55.5, 61, 87.1, 87.11, 19.1, 158–160; 30/322; 211/64

[56] References Cited

U.S. PATENT DOCUMENTS

| | | | |
|---|---|---|---|
| D. 26,777 | 3/1897 | Donnelly | 294/5 |
| 252,738 | 1/1882 | Chesbro | 294/61 |
| 625,201 | 5/1899 | Proctor | 294/61 |
| 885,580 | 4/1908 | Breckenridge . | |
| 945,520 | 1/1910 | Greenwood . | |
| 1,350,984 | 8/1920 | Blank et al. | 294/87.1 |
| 1,579,552 | 4/1926 | Ludlow . | |
| 2,151,281 | 2/1939 | Stalkfleet . | |
| 2,401,174 | 5/1946 | McAuley . | |
| 2,764,326 | 3/1956 | Stanton . | |
| 3,712,660 | 1/1973 | Moore | 294/61 |
| 4,794,683 | 1/1989 | Pacheco | 294/15 |
| 5,119,563 | 6/1992 | Willner, Jr. | 30/322 |
| 5,188,328 | 2/1993 | Thompson . | |
| 5,490,701 | 2/1996 | Glass | 294/61 |
| 5,503,276 | 4/1996 | Pierce . | |

FOREIGN PATENT DOCUMENTS

| | | |
|---|---|---|
| 369991 | 2/1923 | France . |
| 603079 | 4/1926 | Germany . |

*Primary Examiner*—Dean Kramer
*Attorney, Agent, or Firm*—Walter J. Tencza, Jr.

[57] ABSTRACT

An apparatus for handling a handgun is provided. The handgun includes a barrel with a cylindrical cavity having a selected internal diameter. A handle has a selected length with a grip end and a platform end. The grip end is sized and shaped to be grasped by a human hand. The handle has a handle diameter. A platform has a flat, plate shape with a center point, a periphery and a platform diameter extending from across the platform through the center point. The platform diameter is greater than the handle diameter. An elongate member extends through the center of the platform and into the handle. The elongate member is selectively engaged to the handle and to the platform. A first rod has a first selected circumference and is rigidly mounted to the platform near the periphery. A second rod has a second selected circumference different from the first selected circumference and is rigidly mounted to the platform near the periphery. The first selected circumference and the second selected circumference are sized such that at least the first rod or the second rod fits relatively snugly within the cavity of the handgun barrel.

15 Claims, 5 Drawing Sheets

HAND GUN LIFTING AND CARRYING DEVICE

FIELD OF THE INVENTION

This invention is related to the field of fire arm handling devices. In particular, the invention is directed to a single, convenient apparatus for safely lifting handguns having various barrel sizes without smearing existing fingerprints, or making new ones.

BACKGROUND OF THE INVENTION

In the course of police investigations, it is common to come upon handguns at crime scenes. After the location and orientation of the handgun have been photographed, the gun must be moved to a laboratory for testing, such as fingerprinting and ballistic testing. Difficulties arise because there currently exists no convenient and safe way to pick up a handgun (which may or may not be loaded) without getting additional fingerprints on the gun. Further, even if the police officer wears gloves to avoid getting his own fingerprints on the gun, he may well smear any existing fingerprints such they cannot be read or "lifted" with accuracy.

It has become the habit of certain police officers, when faced with this situation, to use a pen or pencil to carry the handgun. In particular, the pen is inserted into the barrel of the gun. The gun is then tilted such that the barrel rests on the pen and/or the tip of the barrel rests on the officer's finger. While allowing the officer to lift the gun without destroying any fingerprint evidence, this practice can be particularly dangerous.

Due to the relatively short length of a pen and the high torque created by the weight of the gun, it can be difficult to support the weight of a handgun in this manner, particularly since pens and pencils typically have smooth sides, not well adapted for gripping under heavy loads. This difficulty is exacerbated if the gun is very heavy, as can be the case with certain high caliber or automatic weapons. Further, the pen may be substantially smaller than the barrel of the gun such that there is a very loose fit, which increases the chances that the gun will slip off the pen. As a result, officers may drop the pen (and thus the gun). Obviously, this can cause the weapon to fire or be damaged, thereby reducing its value as evidence. Further, as the gun starts to slip, an officer may reach down with his free hand, getting his own prints on the gun, the exact problem he was seeking to avoid. Even if the gun does not fall off the pen, pens, pencils and the like are writing instruments, typically maintained in the pockets of the officer. As such they may leave ink, cloth fibers or others residue in the gun barrel which can jeopardize the quality of the evidence. Even if no residue is left, the pen can scratch the barrel, potentially effecting any later ballistic tests.

Various devices have been developed over the years to hold guns. However, none of these prior art devices are intended to lift a gun without getting fingerprints or other contaminants on the gun.

U.S. Pat. No. 5,503,276 is directed to a handgun stand. A vertical panel is mounted on a base. Slots are disposed in the vertical panel. A stud is slidingly mounted in the slot and can be locked at a given position along the slot. The stud can be inserted into the barrel of the gun thereby maintaining the gun in a standing position. There is no teaching or suggestion to use this device to pick up guns safely while avoiding adding fingerprints to the gun.

U.S. Pat. No. 945,520 issued on Jan. 4, 1910 and is directed to a revolver display stand. Referring to the embodiment shown in FIG. 4, an arm 4' is mounted to a body portion 2'. The body portion acts as a base. A sleeve 5' is mounted at an angle on the arm 4'. The barrel of the handgun can be positioned over the sleeve and thus held in place. Again, there is no teaching or suggestion to use this device to pick up guns safely while avoiding adding fingerprints to the gun, let alone providing a means to lift guns of varying caliber with a single apparatus.

None of these patents disclose a device for safely picking up and carrying a handgun without smearing fingerprints or creating new fingerprints, let alone carrying handguns of various barrel sizes, as taught and claims by the instant invention. In fact, none of these references recognize the difficulty of picking up a gun at a crime scene without contaminating the potential evidence.

SUMMARY OF INVENTION

It is an object of an aspect of the present invention to provide a convenient apparatus adapted to safely carry handguns of various sizes without getting additional fingerprints on the guns.

It is an object of another aspect of the invention to provide a device which can be used to pick up a gun from a surface without sliding the gun along the surface and without contacting the exterior of the gun.

It is another object of an aspect of the invention to provide a gun handling device which can be used to pick up guns in tight quarters, such as when a gun is positioned near a wall.

It is another object of an aspect of the invention to provide an apparatus for lifting and manipulating handguns of various sizes while reducing the risk that the gun will be dropped.

In accord with one aspect of the invention, an apparatus for handling a handgun is provided. The handgun includes a barrel with a cylindrical cavity having a selected internal diameter. A handle has a selected length with a grip end and a platform end. The grip end is sized and shaped to be grasped by a human hand. The handle has a handle diameter. A platform has a flat, plate shape with a center point, a periphery and a platform diameter extending from across the platform through the center point. The platform diameter is greater than the handle diameter. An elongate member extends through the center of the platform and into the handle. The elongate member is selectively engaged to the handle and to the platform. A first rod has a first selected circumference and is rigidly mounted to the platform near the periphery. A second rod has a second selected circumference different from the first selected circumference and is rigidly mounted to the platform near the periphery. The first selected circumference and the second selected circumference are sized such that at least the first rod or the second rod fits relatively snugly within the cavity of the handgun barrel.

Certain implementations of this aspect of the invention provide that: a third rod has a third selected circumference different from the first selected circumference and the second selected circumference and is rigidly mounted to the platform near the periphery; the handle includes a central axis which extends through the center of the platform, the platform has a circular profile and the first rod, second rod and the third rod are symmetrically disposed about the central axis on the platform; the first rod, the second rod and the third rod are substantially cylindrical and extend parallel to the central axis; a fourth rod has a fourth selected circumference different from the first selected circumference, the second selected circumference and the third selected circumference and is rigidly mounted to the platform near the periphery.

In accord with another aspect of the invention, an apparatus for handling a gun is provided. A barrel has an internal cavity with a cavity diameter. A handle has a selected length with a grip end and a platform end. The grip end is sized and shaped to be grasped by a human hand. The handle has a handle diameter. A platform has a plate shape with a center point, a periphery and a platform diameter extending from across the platform through the center point. The platform diameter is greater than the handle diameter. The platform is selectively engaged to the handle. A first rod has a first selected circumference and is rigidly mounted to the platform near the periphery. A second rod has a second selected circumference different from the first selected circumference and is rigidly mounted to the platform near the periphery. The first selected circumference and the second selected circumference are sized such that at least the first rod or the second rod fits relatively snugly within the cavity of the handgun barrel. Either the first rod or the second is disposed within the cavity of the barrel.

Certain implementations of this aspect of the invention provide that: a third rod has a third selected circumference different from the first selected circumference and the second selected circumference and is rigidly mounted to the platform near the periphery; the handle includes a central axis which extends through the center of the platform, the platform has a circular profile and the first rod, the second rod and the third rod are symmetrically disposed about the central axis on the platform in a non-linear pattern; the first rod, the second rod and the third rod are substantially cylindrical and extend parallel to the central axis; a fourth rod having a fourth selected circumference different from the first selected circumference, the second selected circumference and the third selected circumference is rigidly mounted to the platform near the periphery.

In accord with another aspect of the invention, an apparatus for handling and manipulating a handgun is provided. The handgun has a barrel with an internal cavity with a barrel axis. A handle has a grip end and a mounting end. The grip end is adapted to be held in a human hand. A platform is mounted to the handle and has an inner side and an outer side with a center point and a periphery. The mounting end of the handle is adjacent to and in a mating relationship with the outer side of the platform. A first rod is attached to the inner side of the platform and has a first selected diameter. A second rod is attached to the inner side of the platform and has a second selected diameter. The first selected diameter is greater than the second selected diameter. The first selected diameter and the second selected diameter are selected such that at least the first rod or the second rod fit snugly within the cavity of the barrel when the first rod or the second rod is positioned along the barrel axis.

Certain implementations of this aspect of the invention provide that: a sheath is disposed about the first rod and the second rod; the platform is releasably engaged to the outer side of the handle; a third rod has a third diameter different from the first diameter and the second diameter and is mounted to the platform near the periphery; a fourth rod having a fourth diameter different from the first diameter, the second diameter, and the third diameter is mounted to the platform near the periphery; at least the first rod is releasably mounted to the platform; the first rod, the second rod, the third rod and the fourth rod are cylindrical and extend parallel to a central axis extending through the handle; a padding is mounted to the inner side of the platform; the platform is releasable engaged to the handle and a finger grip is positioned on the platform near the periphery; a bolt extends through the platform and into the handle, thereby releasably securing the platform to the handle.

DESCRIPTION OF PREFERRED EMBODIMENTS

Figure 1:
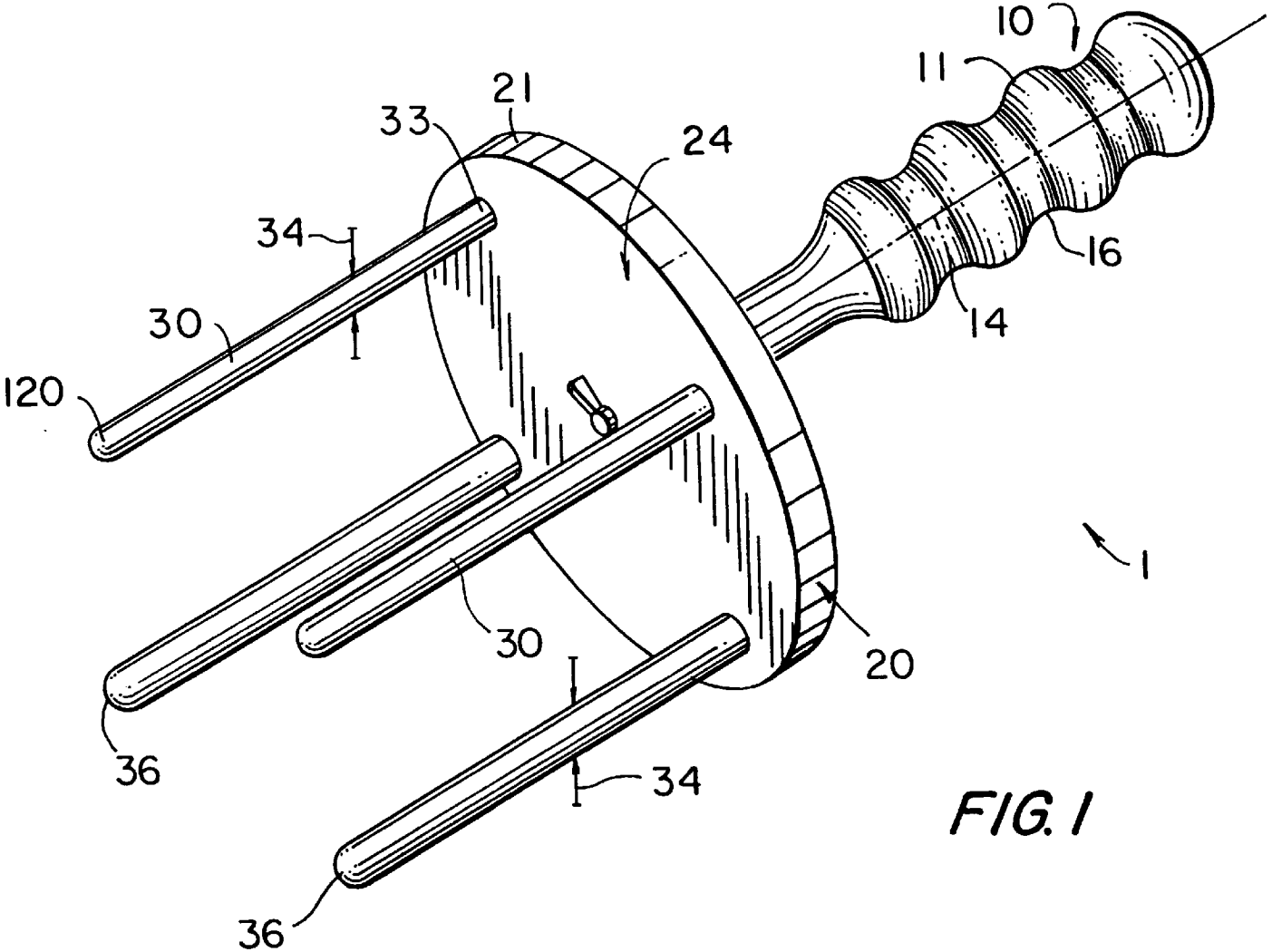
FIG. 1 is a front perspective view of an apparatus in accord with an aspect of the instant invention.
Figure 2:
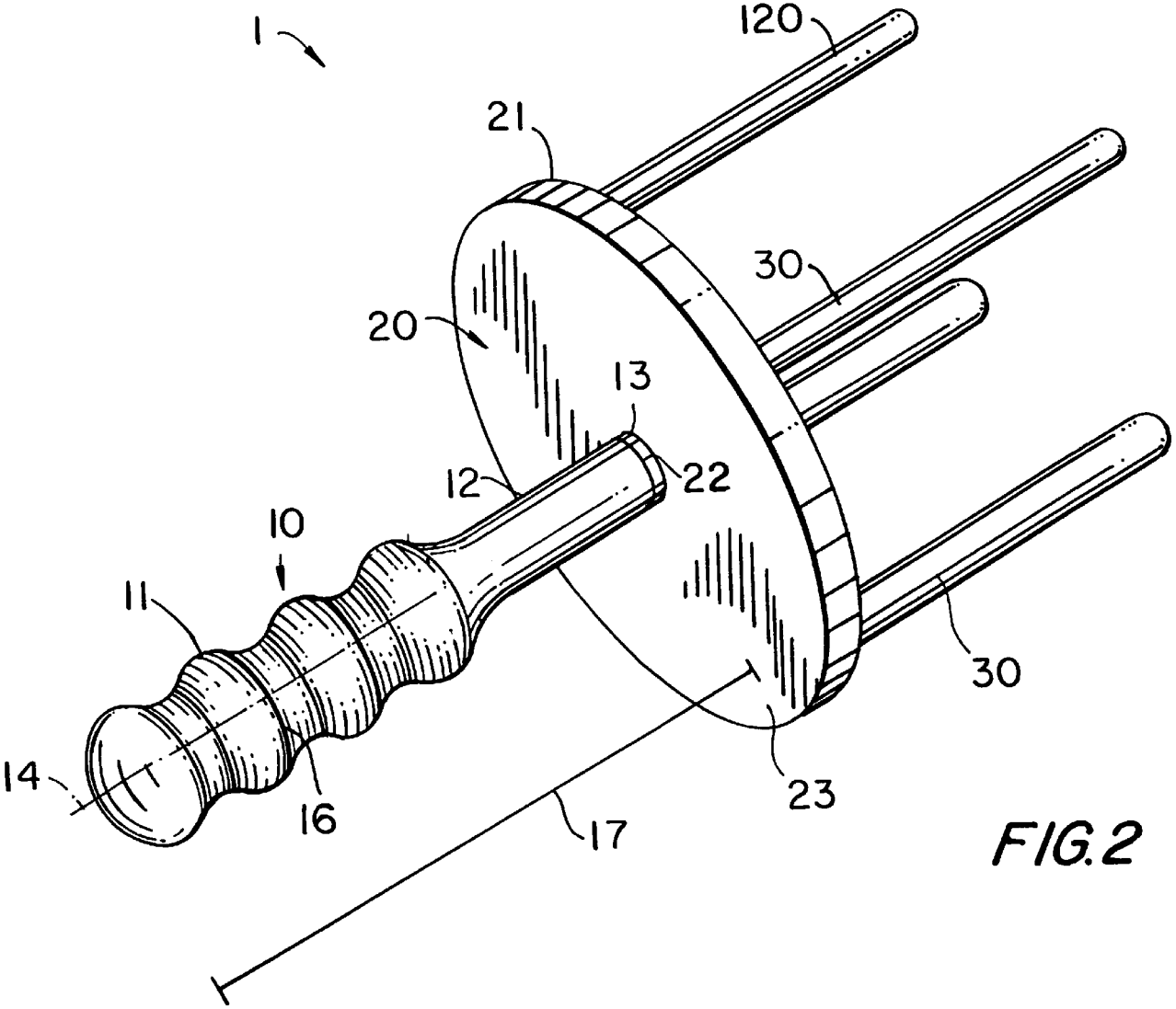
FIG. 2 is a rear perspective view of the apparatus of FIG. 1.

Referring to FIGS. 1 and 2, the invention is directed to an apparatus 1 for lifting and carrying a handgun. A handle 10 has a selected length 17 and a handle diameter 15 (see FIG. 3). The handle has a grip end 11 and a base end 12. A handle axis 14 extends through the handle from the grip end to the base end. The handle is sized and shaped to be easily gripped by a human hand. As such, it may be provided with a bulbous shape, ridges 16, a rubber or neoprene casing 18 at the grip end and similar features which allow it to be held easily, as one skilled in the art would appreciate. The handle can be about 4.75 inches long. A cap 13 can be provided at the base end to maintain the integrity of the handle and to provide a better mating fit with the platform 20 (discussed below). Preferably, the handle is made of wood or plastic. It will be appreciated that other materials can be employed and still practice the invention. For example, the handle could be made of aluminum or other metal. It certain applications it may be desirably to form the handle of an easily cleaned material, thereby reducing the chance that the apparatus would contaminate a crime scene.

Figure 3:
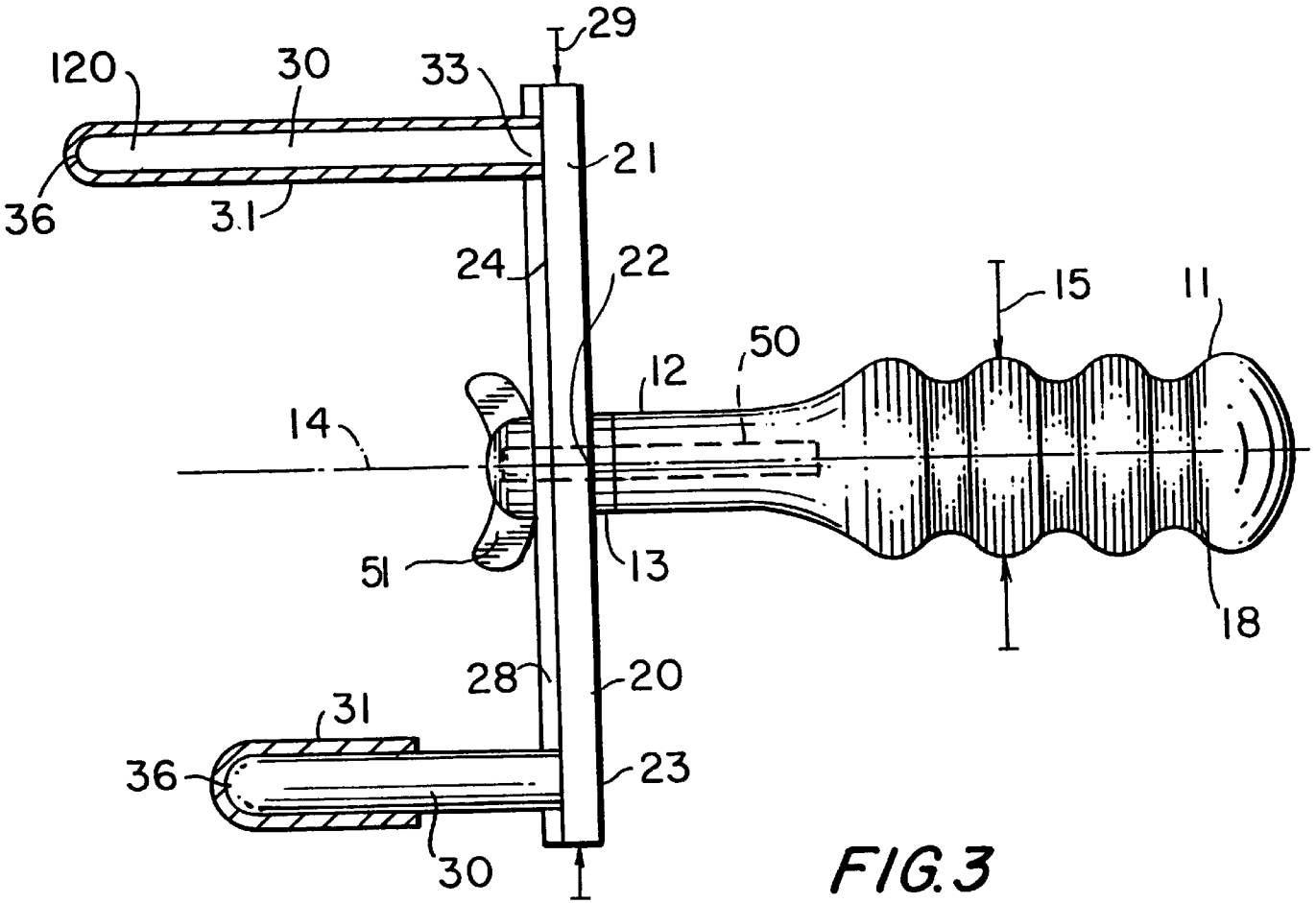
FIG. 3 is a side elevation view in partial cut-away of the apparatus of FIG. 1.

A platform 20 is releasably engaged to the handle 10 at the base end 12. Referring to FIGS. 1, 2 and 3, the platform has a first or inner surface 23 and a second or outer surface 24. The base end 12 of the handle is positioned directly adjacent to the inner surface of the platform in mating engagement at the center 22 of the platform (see also FIGS. 5 and 6). Preferably, the base end 12 (or the cap 13, when employed) has a flat shape which matches the flat shape of the inner surface of the platform of course, the inner surface may be curved, in which case the base end 12 or cap will be formed to match the shape of the inner surface such that they will mate together without wobbling, as one skilled in the art would appreciate.

Referring to FIG. 3, a carriage bolt 50, or the like, can be employed to releasably connect the platform 20 to the handle 10. The bolt extends through the center 22 of the platform and is threaded to a bore disposed in the handle along the handle axis 14. A 5/16×5 inch carriage bolt has been found acceptable. A wing nut 51 threaded to the carriage bolt prevents the platform from detaching from the handle. It will be appreciated that other means, such as clips or snaps, can be employed to releasably secure the platform to the handle. Further, the platform can be permanently attached to the handle, if desired.

Figure 5:
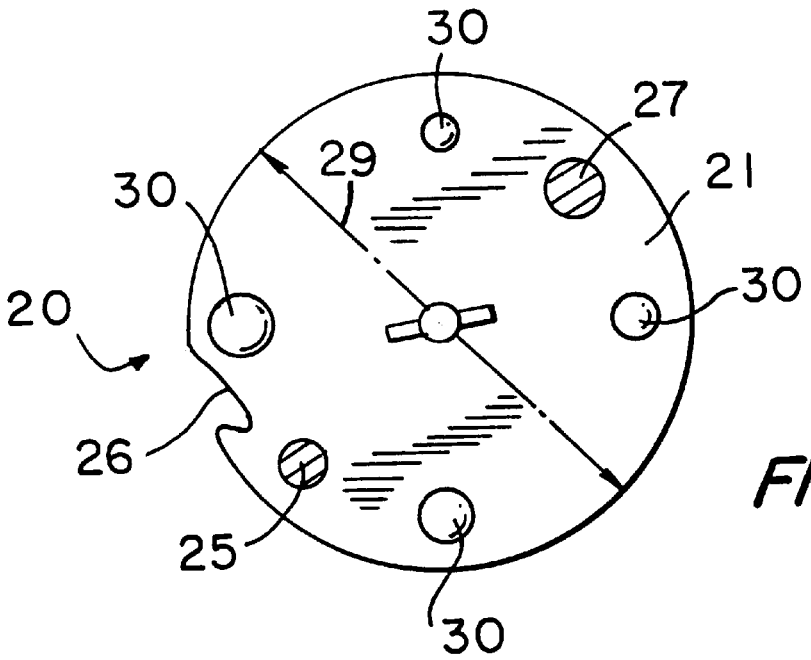
FIG. 5 is a front elevation view of another embodiment of the platform of the instant invention.

In one embodiment shown in FIGS. 1, 2 and 5, the platform 20 has a flat plate shape with a circular profile. The periphery 21 of the platform is disposed about the center 22 of the platform. A platform diameter 29 extends across the platform, from one side of the periphery to the other through the center of the platform. The platform diameter is larger than the handle diameter 15 such that the periphery of the platform extends beyond the handle in a direction perpendicular to the handle axis 14.

The platform 20 can also be provided with different shapes and still practice the invention. For example, the platform can have a square or rectangular profile. Further, a cross-shape can be employed with a 4 inch diameter (see FIG. 6). Other different shapes can be used as a particular application dictates. However, it is preferred that the periphery 21 of the platform 20 extend beyond the handle 10, regardless of the platform shape.

Rods 30 having free ends 120 and attachment or base ends 33 are attached to the outer surface 24 of the platform 20 near the periphery 21. The free end includes a tip 36 which is rounded. The rods can have a cylindrical shape and extend parallel to the handle axis 14. At least two rods are employed, each with a different diameter 34 or circumference. Preferably four rods are employed, each with a different diameter, increasing as you move around the platform in a clockwise or counterclockwise direction (see FIG. 6). These rods are disposed symmetrically about the center 22 of the platform in a non-linear pattern. This arrangement (as opposed to a linear arrangement) positions all the rods relatively near the handle axis 14, thus reducing the torque on the handle 10 when lifting the handgun 40. This also results in a more compact and convenient apparatus. Of course, any number of rods in any pattern can be used and still practice the invention so long as there is adequate room to receive the gun barrel 41 (see FIG. 4). The rods can also have an oval cross section (see FIG. 5, showing one rod with an oval cross section). Further, the rods can be tapered such that the free ends are slightly larger than the attachment ends to better hold the gun 40.

As currently preferred, the rods 30 are permanently attached to the outer surface 24 of the platform 20. Alternatively, the rods can be releasably attached, such as by using a bolt arrangement as employed for the handle 10. In this embodiment, the user can employ a large number of rods having a wide variety of diameters and shapes. When it is desired to lift and handle a gun 40, the user can simply select the rods 30 which are believed to best fit the barrel 41 of the particular gun based, in part on the apparent size and weight of the gun. In particular, the rod with a diameter close too but still less than the diameter of the cavity 42 will provide the best, relatively snug fit. Further, the user can employ rods of varying lengths as seen in FIG. 3. A shorter rod may be desirable when the gun is located near a wall and it would be difficult to position the handle 10 and a long rod between the wall and the opening 44 of the gun barrel 41. The dimensions, either the diameter and/or the length, of the rods are selected such that at least one of the rods securely engages the cavity of the barrel. These dimensions are preferably varied among the rods so that a single apparatus is effective at engaging several different caliber handguns.

It will be understood that the size of the rods 30, including their lengths and diameters, can be varied to better fit different handguns. Currently, it is preferred that each rod is about 4 inches long. The rods have diameters of 3/16 inch, 1/4 inch, 5/16 inch and 3/8 inch.

As shown in FIG. 3, a sleeve 31 can be provided over the rods 30. The sleeve can be a flexible, non-slip material, such as neoprene or rubber, which will allow the rod to engage the cavity 42 of the barrel 41 without risking scratching the barrel wall 43, and thus effecting later ballistic tests. Further, the friction between the sleeve and the barrel wall will reduce the likelihood that the barrel will slip off the rod. Obviously, other types of coatings could be employed, as a particular application dictates. Further, the sleeve could be provided only along a portion of the length of the rod, as shown in FIG. 3.

A padding 28 can be provided on the outer surface 24 of the platform 20. Again, this padding can be a neoprene or rubber material. The padding will prevent scratching the tip of the gun barrel 41 as the gun 40 is lifted and carried.

Referring to FIG. 5, a cross section of one embodiment of the platform 20 is shown. A grip 27, such as an indent or an aperture 25, can be provided to allow a user to pick up the apparatus 1 when the handle 10 is removed. An additional cut-out 26 can be provided to rest the users thumb against when his fingers are in the aperture.

Figure 6:
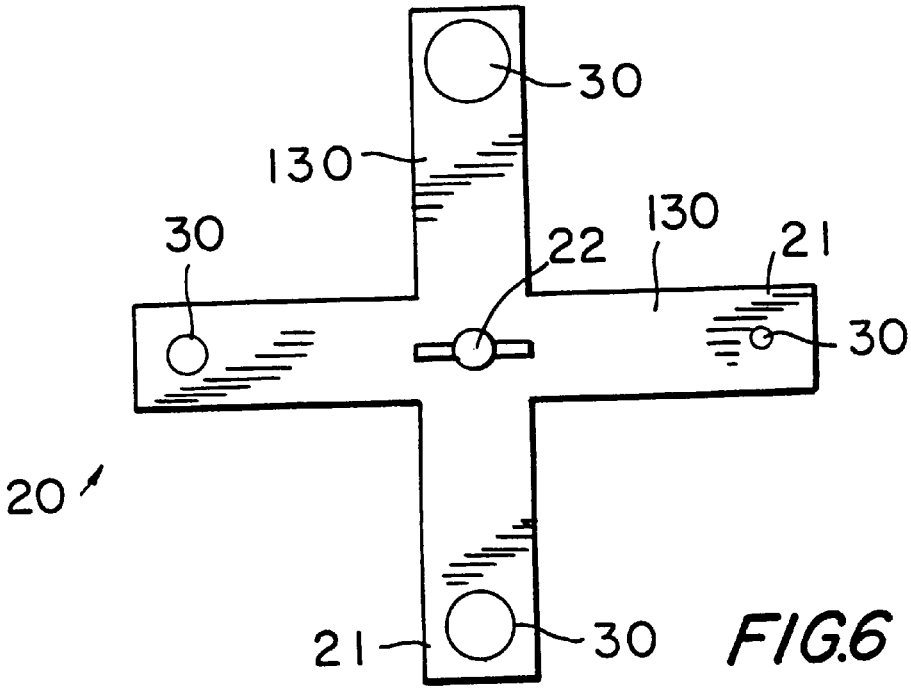
FIG. 6 is a front elevation view of another embodiment of the instant invention with a cross-shaped platform.

Referring to FIG. 6, another embodiment of the platform 20 is depicted. The platform has a cross-shape with the rods 30 located at the ends or periphery 21 of each arm 130 of the cross. Obviously, if different numbers of rods are used, a corresponding number of arms can be provided.

As seen, the rods are preferrably arranged such that the smallest diameter rod is opposite the second smallest diameter rod and the largest diameter rod is opposite the second largest diameter rod. As such, when lifting a large caliber (and thus heavy) weapon, the police officer can grasp one of the larger rods.

Figure 4:
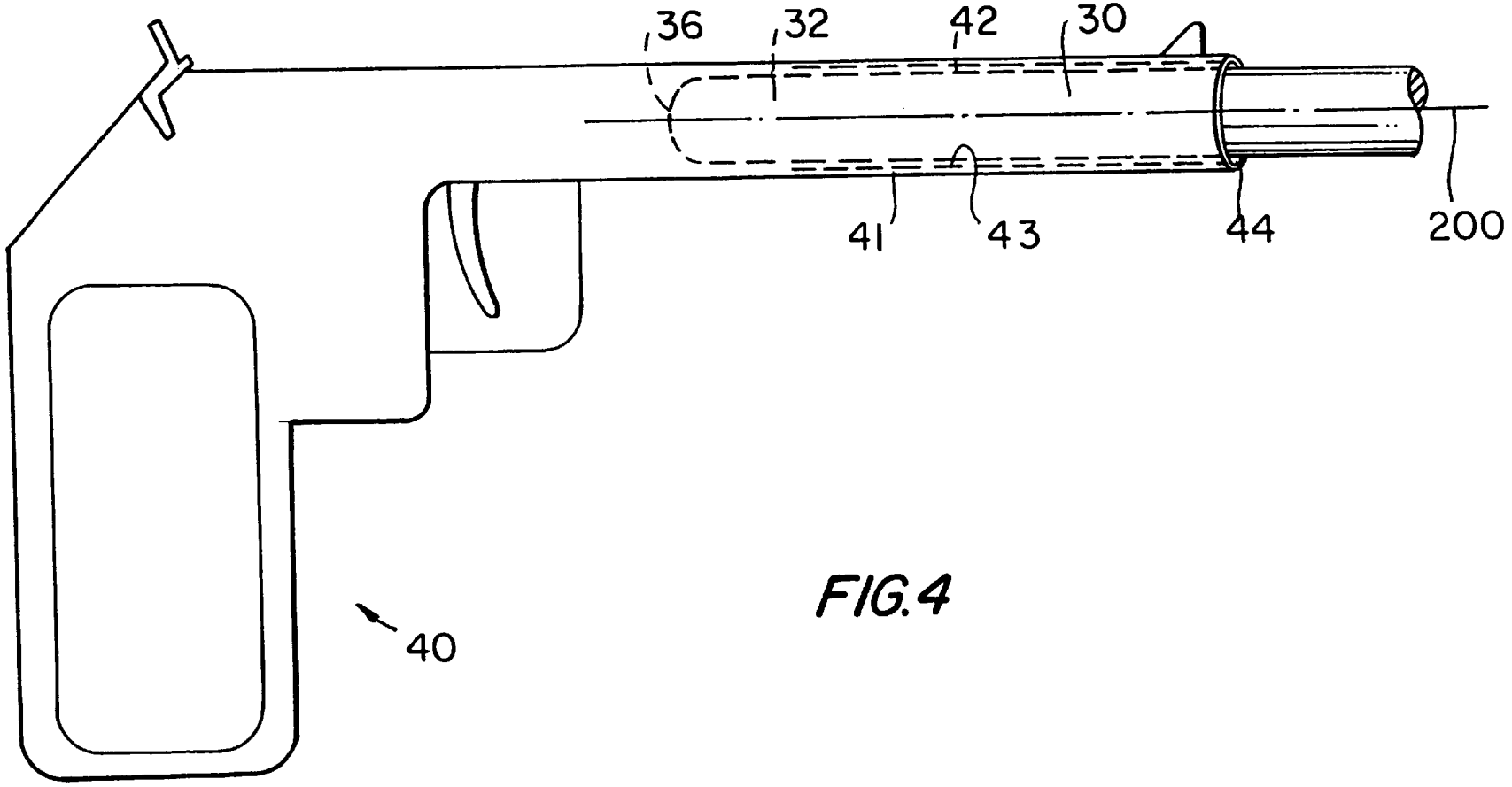
FIG. 4 is a side view of a rod of the apparatus of FIG. 1 engaged to a handgun.

To use the apparatus 1 of the invention, the user grasps the handle 10 at the grip end 11. If the rods 30 are removable, the user selects which rods he desires to use and attaches them to the outer surface 24 of the platform 20 at the periphery 21. With the apparatus in hand, the user then selects the rod which will most closely fit the cavity 42 of the barrel 41. Preferably, the rod length and the diameters are such that there is limited play between the barrel wall 43 and the selected rod, as seen in FIG. 4. However, the fit should not be so tight as to require that the rod be forced into the barrel. The dimensions of the rod will vary depending on the size of the cavity of the barrel, as one skilled in the art would appreciate. The rod should not be so long that the tip 36 would engage or contact a bullet in the gun chamber.

The user manipulates the handle 10 and aligns the free end 32 of the rod 30 with the opening 44 of the barrel 41. The rod is then inserted into the cavity 42 of the barrel along the barrel axis 200, as seen in FIG. 4. The curved shape of the tip 36 encourages the rod to slip in easily. The handle 10 is tilted such that the free end of the rod (which is in the barrel) extends upward, thereby lifting the gun 40 off the surface. The user can then move the gun around without touching the outside of the gun or scratching the barrel. Due to the selection of a rod with an appropriate diameter, there is little play between the rod and the barrel, reducing the chance that the barrel will slide off. This risk can be further reduced by providing the non-slip sleeve 31 to the rod.

At certain times, the gun 40 may be located directly adjacent to an obstacle, such as a wall or a table. At these times, it will be difficult if not impossible to position the apparatus 1 between the tip of the barrel 41 and the object such that the rod 30 can be aligned with the cavity 42. To reduce the over length of the apparatus, the handle can be removed. Preferably, the wing nut 51 is simply unthreaded from the carriage bolt 50, thereby allowing the platform 20 to detach from the handle 10. The platform can then be gripped by an opposing rod, the grip 27 or the aperture 25. Alternatively, the user can grasp the surfaces 23, 24 of the platform between his fingers. Without the handle attached to the platform, the user will more readily be able to align the rod with the cavity despite close objects. To further address this problem, rods of a shorter length can be provided. While not as stable as a longer rod, the shorter rod will permit lifting a gun in even tighter quarters.

While this invention has been described with reference to specific embodiments disclosed herein, it is not confined to the details set forth and the patent is intended to include modifications and changes which may come within and extend from the following claims.

I claim:

1. An apparatus for handling a hand gun, wherein the hand gun includes a barrel with a cylindrical cavity having a selected internal diameter, the apparatus comprising:

a handle having a selected length with a grip end and a platform end, wherein the grip end is sized and shaped to be grasped by a human hand, the handle having a handle diameter;

a platform having a plate shape with a center point, a periphery and a platform diameter extending straight across the platform through the center point, wherein the platform diameter is greater than the handle diameter;

an elongate member extending through the center of the platform and into the handle, wherein the elongate member is selectively engaged to the platform;

a first rod having a first selected circumference and a first selected length, the first rod being rigidly mounted to the platform near the periphery; and a second rod having a second selected circumference different from the first selected circumference and a second selected length, the second rod being rigidly mounted to the platform near the periphery;

wherein the first selected circumference and the second selected circumference are sized such that at least the first rod or the second rod fits relatively snugly within the cavity of the handgun barrel.

2. The apparatus of claim 1 further comprising a third rod having a third selected circumference different from both the first selected circumference and the second selected circumference, the third rod being rigidly mounted to the platform near the periphery.

3. The apparatus of claim 2 wherein the handle includes a central axis which extends through the center of the platform and wherein the platform has a circular profile and the first rod, second rod and the third rod are symmetrically disposed about the central axis on the platform in a non-linear pattern.

4. The apparatus of claim 2 further comprising a fourth rod having a fourth selected circumference different from each the first selected circumference, the second selected circumference and the third selected circumference, the fourth rod being rigidly mounted to the platform near the periphery.

5. The apparatus of claim 4 wherein the platform has a cross shape with four arms and wherein each rod is mounted to the periphery of each arm.

6. The apparatus of claim 1 wherein the first selected length differs from the second selected length.

7. An assembly comprising in combination:

a gun comprised of a barrel having an internal cavity with a cavity diameter; and an apparatus for lifting and handling the gun comprised of:

a handle having a selected length with a grip end and a platform end, wherein the grip end is sized and shaped to be grasped by a human hand, the handle having a handle diameter;

a platform having a center point, a periphery and a platform diameter extending across the platform through the center point, wherein the platform diameter is greater than the handle diameter;

wherein the platform is engaged to the handle at the platform end;

a first rod having a first selected circumference, the first rod being rigidly mounted to the platform near the periphery;

a second rod having a second selected circumference, the second rod being rigidly mounted to the platform near the periphery; and a third rod having a third selected circumference, the third rod being rigidly mounted to the platform near the periphery, wherein the first rod, the second rod and the third rod are disposed symmetrically about the center point in a non-linear pattern;

wherein the first selected circumference, the second selected circumference and the third selected circumference are sized such that at least the first rod, the second rod or the third rod fits relatively snugly within the cavity of the gun barrel; and wherein either the first rod, the second rod or the third rod is disposed within the cavity of the barrel.

8. The assembly of claim 7 wherein the first selected circumference and the second selected circumference are different.

9. An apparatus for lifting and handling an object comprising:

a handle having a selected length with a grip end and a platform end, wherein the grip end is sized and shaped to be grasped by a human hand, the handle having a handle diameter;

a platform having a center point, a periphery and a platform diameter extending across the platform through the center point; wherein the platform diameter is greater than the handle diameter;

wherein the platform is engaged to the handle at the platform end;

a first rod having a first selected circumference, the first rod being rigidly mounted to the platform near the periphery; and a second rod having a second selected circumference, the second rod being rigidly mounted to the platform near the periphery;

a third rod having a third selected circumference, the third rod being rigidly mounted to the platform near the periphery;

wherein the first rod, the second rod and the third rod are disposed symmetrically about the center point in a non-linear pattern;

and wherein the first selected circumference and the second selected circumference are different;

further comprising a non-skid sleeve disposed about at least the first rod.

10. An apparatus for lifting and handling an object comprising:

a handle having a selected length with a grip end and a platform end, wherein the grip end is sized and shaped to be grasped by a human hand, the handle having a handle diameter;

a platform having a center point, a periphery and a platform diameter extending across the platform through the center point; wherein the platform diameter is greater than the handle diameter;

wherein the platform is engaged to the handle at the platform end;

a first rod having a first selected circumference, the first rod being rigidly mounted to the platform near the periphery;

a second rod having a second selected circumference, the second rod being rigidly mounted to the platform near the periphery; and a third rod having a third selected circumference, the third rod being rigidly mounted to the platform near the periphery;

wherein the first rod, the second rod and the third rod are disposed symmetrically about the center point in a non-linear pattern;

further comprising a fourth rod having a fourth selected circumference different from each of the first selected circumference, the second selected circumference and the third selected circumference, the fourth rod being rigidly mounted to the platform near the periphery.

11. An apparatus for handling and manipulating a handgun, which handgun has a barrel including an internal cavity with a barrel axis, the apparatus comprising;

a handle having a grip end and a mounting end wherein the grip end is adapted to be held in a human hand;

a platform mounted to the handle and having an inner side and an outer side with a center point and a periphery, wherein the mounting end of the handle is adjacent to and in a mating relationship with the outer side of the platform;

a first rod attached to the inner side of the platform and having a first selected dimension;

a second rod attached to the inner side of the platform and having a second selected dimension;

wherein the first selected dimension is greater than the second selected dimension;

wherein the first selected dimension and the second selected dimension are selected such that at least the first rod or the second rod securely engages the cavity of the barrel when the first rod or the second rod is positioned along the barrel axis inside the internal cavity;

wherein the first selected dimension is the diameter of the first rod and the second selected dimension is the diameter of the second rod;

further comprising a third rod mounted to the platform near the periphery and having a third rod diameter and a fourth rod mounted to the platform near the periphery and having a fourth rod diameter wherein the third rod diameter and the fourth rod diameter are different from the diameter of the first rod and the diameter of the second rod.

12. An apparatus for handling and manipulating a handgun, which handgun has a barrel including an internal cavity with a barrel axis, the apparatus comprising:

a handle having a grip end and a mounting end wherein the grip end is adapted to be held in a human hand;

a platform mounted to the handle and having an inner side and an outer side with a center point and a periphery, wherein the mounting end of the handle is adjacent to and in a mating relationship with the outer side of the platform;

a first rod attached to the inner side of the platform and having a first selected dimension;

a second rod attached to the inner side of the platform and having a second selected dimension;

wherein the first selected dimension is greater than the second selected dimension;

wherein the first selected dimension and the second selected dimension are selected such that at least the first rod or the second rod securely engages the cavity of the barrel when the first rod or the second rod is positioned along the barrel axis inside the internal cavity;

wherein at least the first rod is cylindrical and the second rod has an oval cross section.

13. An apparatus for handling and manipulating a handgun, which handgun has a barrel including an internal cavity with a barrel axis, the apparatus comprising;

a handle having a grip end and a mounting end wherein the grip end is adapted to be held in a human hand;

a platform mounted to the handle and having an inner side and an outer side with a center point and a periphery, wherein the mounting end of the handle is adjacent to and in a mating relationship with the outer side of the platform;

a first rod attached to the inner side of the platform and having a first selected dimension;

a second rod attached to the inner side of the platform and having a second selected dimension;

wherein the first selected dimension is greater than the second selected dimension;

wherein the first selected dimension and the second selected dimension are selected such that at least the first rod or the second rod securely engages the cavity of the barrel when the first rod or the second rod is positioned along the barrel axis inside the internal cavity;

further comprising a sleeve disposed about the first rod and the second rod;

further comprising a padding mounted to the inner side of the platform.

14. An apparatus for handling and manipulating a handgun, which handgun has a barrel including an internal cavity with a barrel axis, the apparatus comprising:

a handle having a grip end and a mounting end wherein the grip end is adapted to be held in a human hand;

a platform mounted to the handle and having an inner side and an outer side with a center point and a periphery, wherein the mounting end of the handle is adjacent to and in a mating relationship with the outer side of the platform;

a first rod attached to the inner side of the platform and having a first selected dimension;

a second rod attached to the inner side of the platform and having a second selected dimension;

wherein the first selected dimension is greater than the second selected dimension;

wherein the first selected dimension and the second selected dimension are selected such that at least the first rod or the second rod securely engages the cavity of the barrel when the first rod or the second rod is positioned along the barrel axis inside the internal cavity;

wherein the platform is releasably engaged to the handle, further comprising a finger grip positioned on the platform near the periphery.

15. The apparatus of claim 14 further comprising a bolt extending through the platform and disposed in the handle and a wing nut selectively engaged to the bolt, thereby releasably securing the platform to the handle.

* * * * *